US006050186A

United States Patent [19]

Tomikura et al.

[11] Patent Number: 6,050,186

[45] Date of Patent: Apr. 18, 2000

[54] ADJUSTABLE SUPPLY RATE DAMPENING MECHANISM FOR PLANOGRAPHIC PRINTING PLATES

[75] Inventors: Keiki Tomikura; Shinji Kawashima, both of Kanagawa, Japan

[73] Assignee: Kabushiki Kaisha Tokyo Kikai Seisakusho, Tokyo, Japan

[21] Appl. No.: 09/249,859

[22] Filed: Feb. 16, 1999

[30] Foreign Application Priority Data

Apr. 20, 1998 [JP] Japan ..... 10-108952

[51] Int. Cl.[7] ..... B41F 3/32; B41F 3/34; B41F 7/30; B41F 7/24

[52] U.S. Cl. ..... 101/147; 101/148; 101/366

[58] Field of Search ..... 101/147, 148, 101/366, 424, 425; 222/548, 555, 556, 557; 239/103, 120, 122, 265.19, 380, 550, 551, 564, DIG. 23; 118/300, 320, 326, 301, 313, 315

[56] References Cited

U.S. PATENT DOCUMENTS

| | | | |
|---|---|---|---|
| 1,719,017 | 7/1929 | Moe et al. . | |
| 3,924,531 | 12/1975 | Kingler | 101/147 |
| 4,044,674 | 8/1977 | Smith, Jr. | 101/148 |
| 4,831,927 | 5/1989 | Lin | 101/148 |
| 5,014,615 | 5/1991 | Lin et al. | 101/147 |
| 5,025,722 | 6/1991 | Switall et al. | 101/147 |
| 5,038,681 | 8/1991 | Hultberg | 101/484 |
| 5,299,495 | 4/1994 | Schoeps et al. | 101/147 |
| 5,644,981 | 7/1997 | Ohno et al. | 101/147 |
| 5,706,723 | 1/1998 | Ohno | 101/148 |
| 5,782,180 | 7/1998 | Schneider et al. | 101/148 |

FOREIGN PATENT DOCUMENTS

| | | |
|---|---|---|
| 14-28072 | 9/1939 | Japan . |
| 5-16334 | 1/1993 | Japan . |
| 63-154225 | 10/1998 | Japan . |

*Primary Examiner*—Kimberly L. Asher
*Attorney, Agent, or Firm*—Nikaido Marmelstein Murray & Oram LLP

[57] ABSTRACT

For moistening a water roller in contact with a planographic printing plate on a plate cylinder in an offset printing press, a sprayer produces a more or less flat spray of dampening water. Baffles are positioned in front of the sprayer to define an aperture through which the spray travels before hitting the water roller. The aperture has a width shorter than the longer dimension of the cross section of the spray as measured in a plane containing the aperture, and longer than the shorter dimension of the cross section of the spray in the same plane. Thus the rate at which the dampening water is supplied to the water roller is infinitely variable by changing the angular position of the spray relative to the aperture between a minimum dampening position where the spray has the opposite longitudinal end portions of its cross section interrupted to the utmost by the baffle means and a maximum dampening position where the spray is allowed wholly through the aperture. In practice a series of rotary sprayers may be arranged along the axis of the water roller.

5 Claims, 5 Drawing Sheets

ADJUSTABLE SUPPLY RATE DAMPENING MECHANISM FOR PLANOGRAPHIC PRINTING PLATES

BACKGROUND OF THE INVENTION

This invention relates to the art of planographic printing and particularly to that of offset lithography. More particularly, the invention pertains to a dampening mechanism for use in offset printing presses, featuring provisions for adjustably varying the rate of supply of moistening water. The term "water" as used in this specification and in the claims appended thereto should be taken to mean not just water but also dampening solutions of any known or suitable compositions consisting mainly of water.

Planography, as is well known, is an art of nonrelief printing such that both the image and nonimage areas of the printing plate are on the same printing surface. The two areas do, however, differ from each other in that the image area is oleophilic (i.e. attracts the greasy ink and repels water) whereas the nonimage area is hydrophilic (i.e. water-attractive and ink-repellent). As the face of the printing plate, clamped around the plate cylinder, is moistened, the nonimage areas of the plate accepts the moisture. The plate is inked by passing under the inking mechanism here the image areas accept the ink. In offset printing, the inked image is transferred from the plate to a blanket on a blanket cylinder and thence retransferred or offset to a web of paper or the like.

Whereas a variety of apparatuses have been suggested and used for dampening the printing plates in offset printing presses, those employing sprayers are winning ever-increasing acceptance in the industry. A sprayer sprays water either on to the printing plate on the plate cylinder or on to a water roller that makes rolling contact, either directly or indirectly, with the plate cylinder.

Japanese Unexamined Utility Model Application No. 63-154225 represents one such conventional approach, teaching a baffle plate cantilevered to a rotary shaft above water sprayers. The baffle plate is angled up and down to regulate the water spray and hence to control the rate at which the water is supplied.

A drawback of this prior art device is that the baffle plate is directly under the pressure of the water being sprayed. The rotary shaft to which the baffle plate is cantilevered is geared to its drive means. Therefore, even under the infinitesimal fluctuations of the spray pressure, the pivoted baffle plate has been susceptible to oscillations within the limitations of the backlash of the drive gearing. Such oscillations of the baffle plate have rendered the control of the moistening rate inaccurate and unreliable. After an extended period of use, moreover, the baffle plate oscillations have often resulted in the malfunctioning of the device through abrasion of the rotary shaft and the parts supporting the same.

Japanese Unexamined Patent Application No. 5-16334 suggests the provision of a solenoid-actuated flow control valve on a conduit leading to a water sprayer. The solenoid valve is automatically opened and closed at intervals depending upon the operating speed of the printing press, so that water is sprayed at intervals either on the plate itself or on a roller in contact therewith.

This known spray system possesses the drawback that the supply rate of water is varied only in discrete steps rather than infinitely. Additionally, it is incapable of varying the supply rate by quantities less than those resulting from the minimum possible intervals at which the solenoid valve is opened and closed.

Japanese Utility Model Publication No. 39-28072 teaches the spraying of water in mixture with air under pressure. The spray rate is controlled by inching the sprayer back and forth in the direction of the spray and by controlling the valves on conduits that convey the water and the compressed air toward the sprayer. It is possible in this manner to adjustably vary not only the rate of spray but the size of the spray drops.

However, when the water pressure is raised for a higher rate of supply, the air pressure may be likely overcome by the water pressure, failing to atomize the water into sufficiently fine particles. With the water thus sprayed in coarse drops, the plate or the water roller often is not uniformly moistened, resulting in uneven printing or smearing of the paper. It must also be pointed out that the adjustment of the moistening rate through control of the water and air pressures is very difficult and demands utmost skill on the part of the press operators.

SUMMARY OF THE INVENTION

An object of the present invention is to realize a continuous change in the rate at which water is actually sprayed on a plate around a plate cylinder or on a water roller in direct or indirect contact therewith in an offset printing press.

Another object of the invention is to attain the first recited object without relying on complex, delicate, costly control of valves.

Another object of the invention is to keep the water sprayed from a sprayer under constant pressure, at a constant rate, and with practically unvarying water particle size but nevertheless to enable fine adjustment of the rate at which the plate is moistened.

Briefly, the present invention may be summarized as a dampening mechanism comprising sprayer means for producing a spray of dampening water, the spray being of such cross sectional shape as to differ in dimensions of two orthogonal directions, and sprayer revolving means for revolving the sprayer means in order to cause angular displacement of the spray about an axis passing through the geometric center of the cross section of the spray. Also included are baffle means defining an aperture through which the spray travels, the aperture having a width shorter than the longer dimension of the cross section of the spray and longer than the shorter dimension of the cross section of the spray, both cross sectional dimensions of the spray under comparison being as measured in a plane containing the aperture.

The "spray of such cross sectional as to differ in dimensions of two orthogonal directions" is, in short, a spray of more or less flat shape, only spreading, with its flat shape unchanged, as it travels away from the sprayer means. Revolved about the axis passing through the geometric center of its cross section, the flat spray has its opposite longitudinal end portions of its cross section variously interrupted by the baffle means when passing through the aperture. Thus the supply rate of dampening water that is allowed through the aperture is infinitely variable by changing the angular position of the spray relative to the aperture between a minimum dampening position where the spray has its opposite longitudinal end portions interrupted to the utmost by the baffle means and a maximum dampening position where the spray is allowed wholly through the aperture.

Among the advantages of this invention over the listed prior art is the fact that, unlike the conventional pivoted baffle plate, the baffle means according to the invention can be mounted in fixed relation to the framework of the printing press, thereby precluding the possibility of vibrating under the pressure of the moistening water spray. The fixed baffle means are far simpler and cheaper in construction, trouble-free in operation, and easier to maintain.

Further, being varied by revolving the spray relative to the baffle means, the supply rate of water is infinitely variable, instead of in discrete steps as has been the case with the conventional on-off control of a solenoid valve.

Still further both water and air can be supplied under constant pressure and at a constant flow rate. No complex means are therefore required for controlling the water and air pressures or flow rates.

Additionally, as the spray is produced constantly, without any change in pressure or flow rate, a film of moistening water can be formed to a unvarying thickness on the surface of the printing plate or the water roller, assuring the production of high quality printings free from uneven densities or smearings.

In the practice of this invention any desired number of such sprayers may be aligned along the axis of a plate cylinder or of a water roller in rolling contact therewith for spraying different axial portions of the cylinder or roller. The rates at which water is sprayed from the sprayers are easily controllable, either altogether or individually, to suit the printing speed.

The above and other objects, features and advantages of this invention will become more apparent, and the invention itself will best be understood from a study of the following description and appended drawings, with reference had to the attached drawings showing some preferable embodiments of the invention.

DESCRIPTION OF THE PREFERRED EMBODIMENTS

Figure 1:
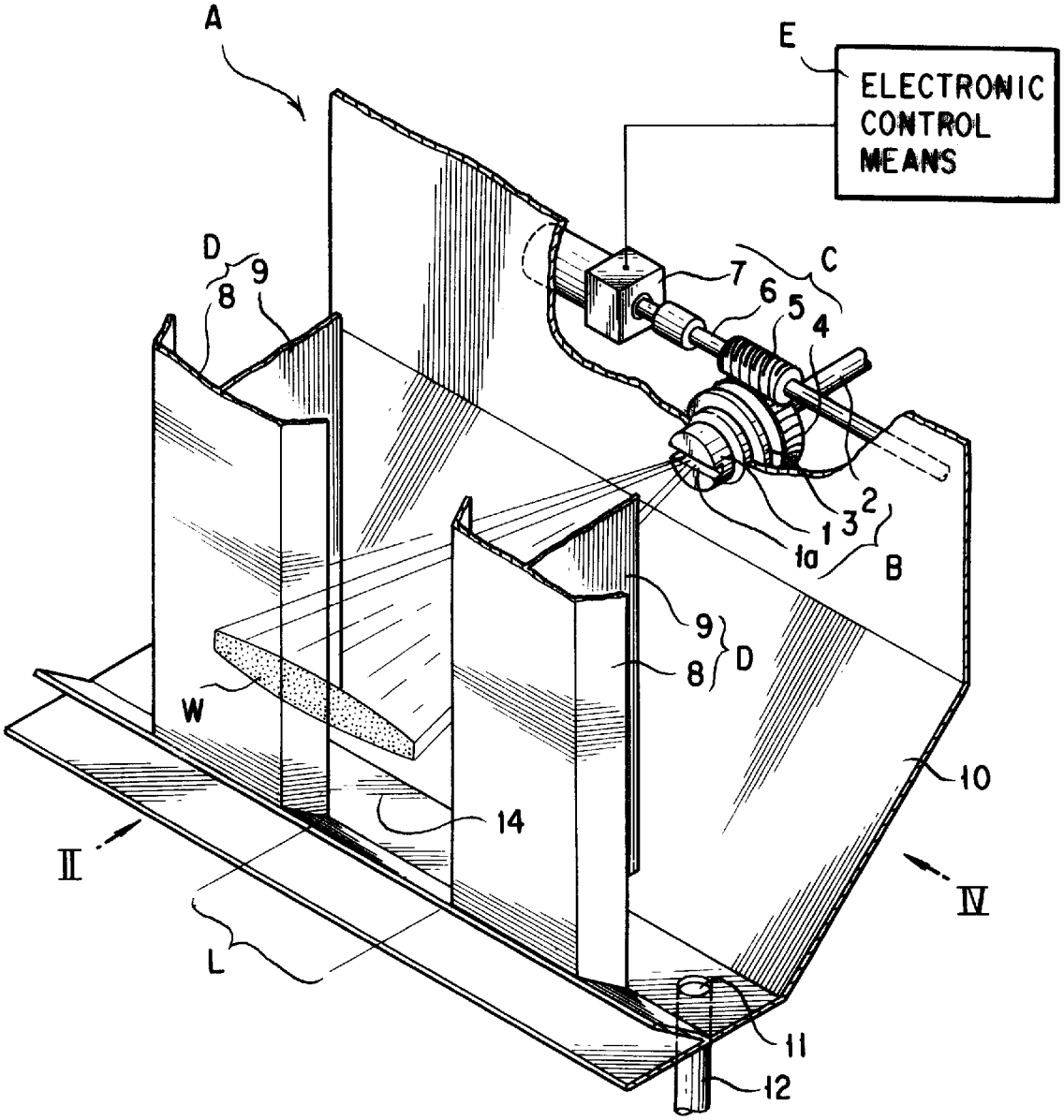
FIG. 1 is a partial perspective view, with parts shown broken away to reveal other parts, of the dampening mechanism constructed in accordance with the novel concepts of this invention.
Figure 2:
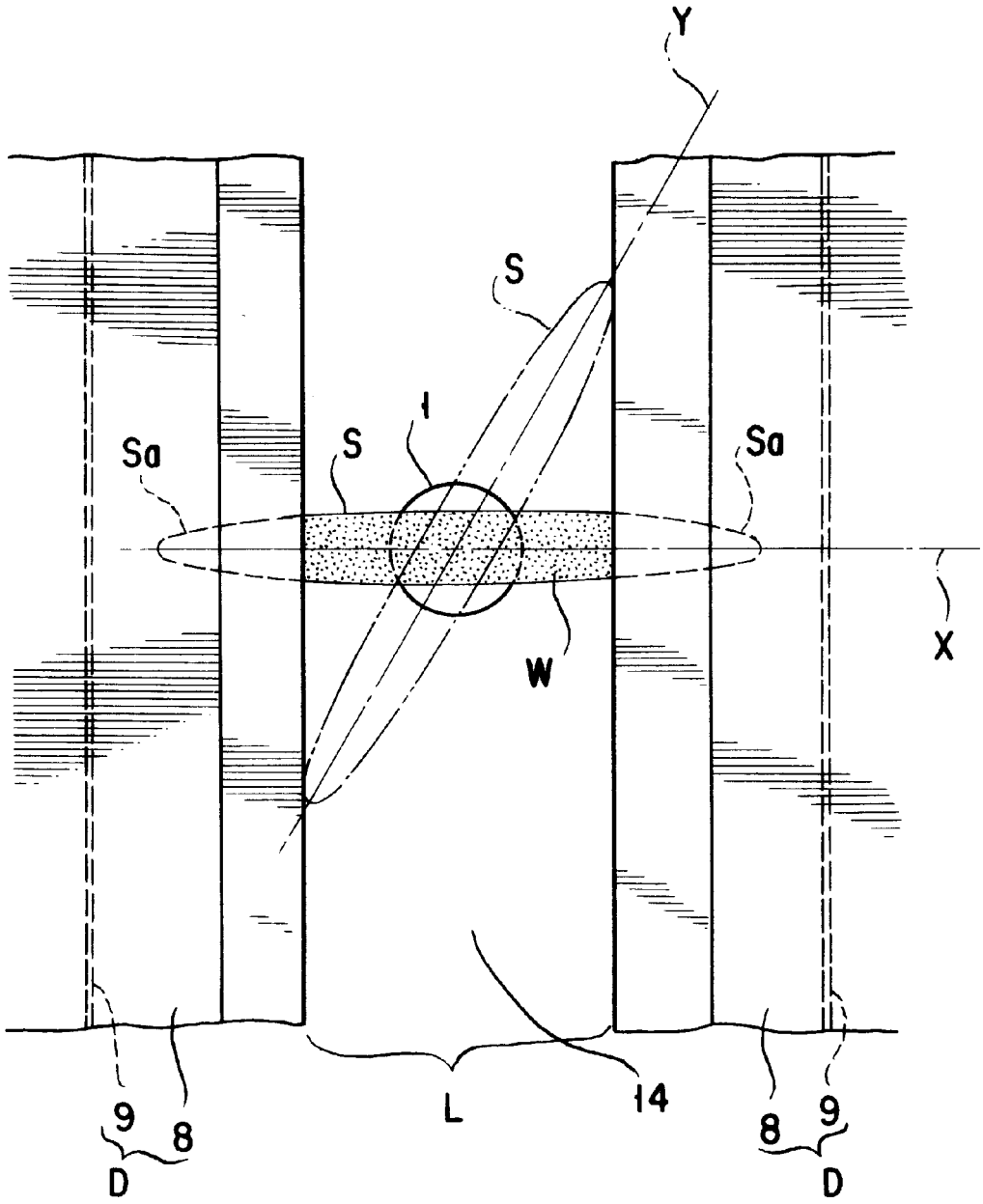
FIG. 2 is a diagrammatic front view, seen in the direction of the arrow II in FIG. 1, of the dampening mechanism, the view being explanatory of how the supply rate of dampening water is adjustably varied with the angular displacement of the spray relative to the baffle means.

The representative dampening mechanism according to the invention is generally designated A in FIG. 1 and therein shown to comprise a sprayer B, sprayer revolving means C, baffle means D, and electronic control means E. The sprayer B emits a water spray W which is sector-shaped as seen in a plan view in FIG. 1 and which, as better illustrated in FIG. 2, is elliptic or otherwise elongate in cross-sectional shape or spray pattern S.

The baffle means D are arranged to define an aperture 14 through which the water spray W travels, either in part or in whole depending upon the angular attitude of the spray. The sprayer revolving means C, shown on a somewhat enlarged scale in FIG. 3, operate under the direction of the electronic control means E to bidirectionally rotate the sprayer B through a preassigned angle about its own axis. As indicated in FIG. 2, with such bidirectional rotation of the sprayer B, the angular attitude of the spray W is variable about an axis passing through the geometric center of the spray between a minimum dampening position X and a maximum dampening position Y.

Figure 4:
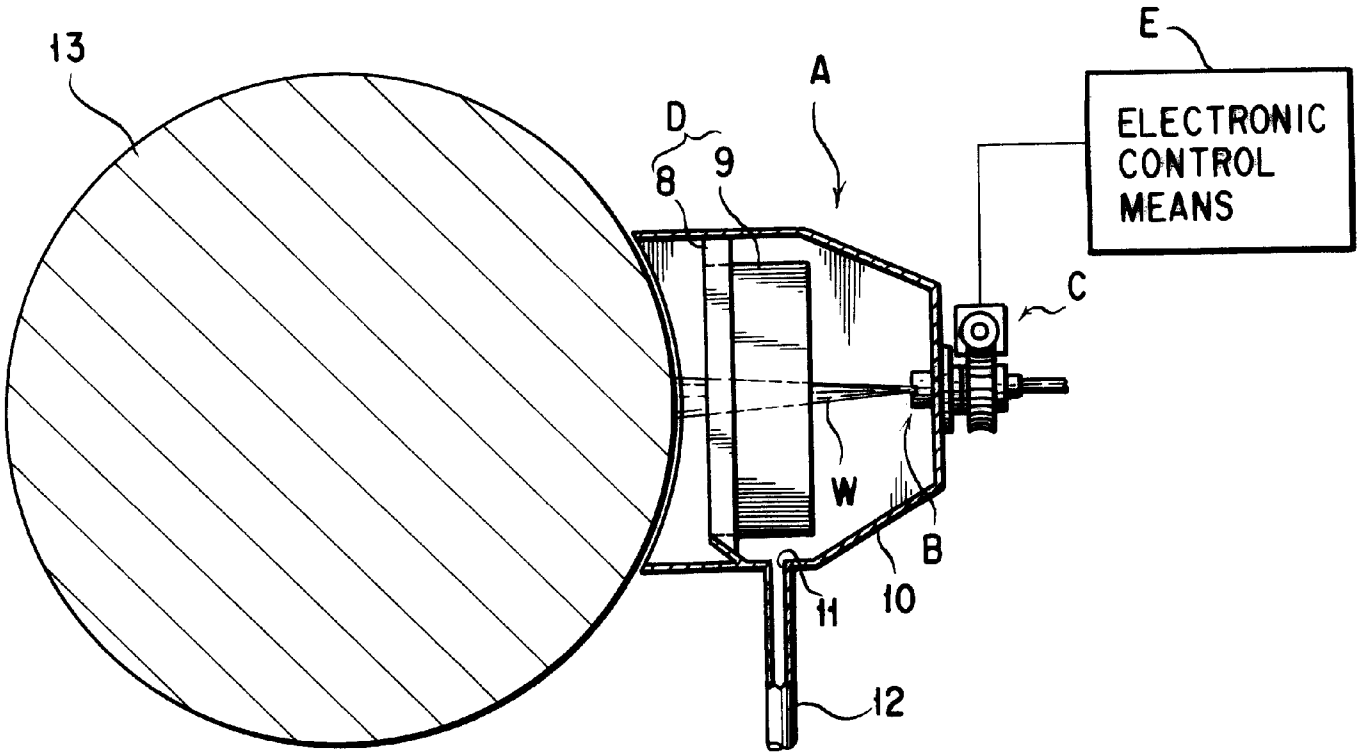
FIG. 4 shows the device of FIG. 1 as seen in the direction of the arrow IV, the dampening mechanism being herein shown together with a water roller to be dampened.

FIG. 4 shows the dampening mechanism A spraying and moistening the face of a water roller 13 from which the printing plate, not shown, on a printing cylinder of the offset printing press is to be watered. It will be observed from this figure that a shroud 10, open to the water roller 13, encloses part of the sprayer B and whole of the baffle means D. The sprayer revolving means C are disposed wholly outside the shroud 10, and the electronic control means E in any convenient location external to the shroud. The shroud 10 has a water drain port 11 in its bottom, with a drain conduit 12 extending therefrom.

The above listed sprayer B, sprayer revolving means C, baffle means D, and electronic control means E will be discussed in more detail hereinbelow, in that order and under separate headings. The operational description of the complete dampening mechanism A will follow the detailed discussion of the listed means B–E.

Sprayer

Figure 3:
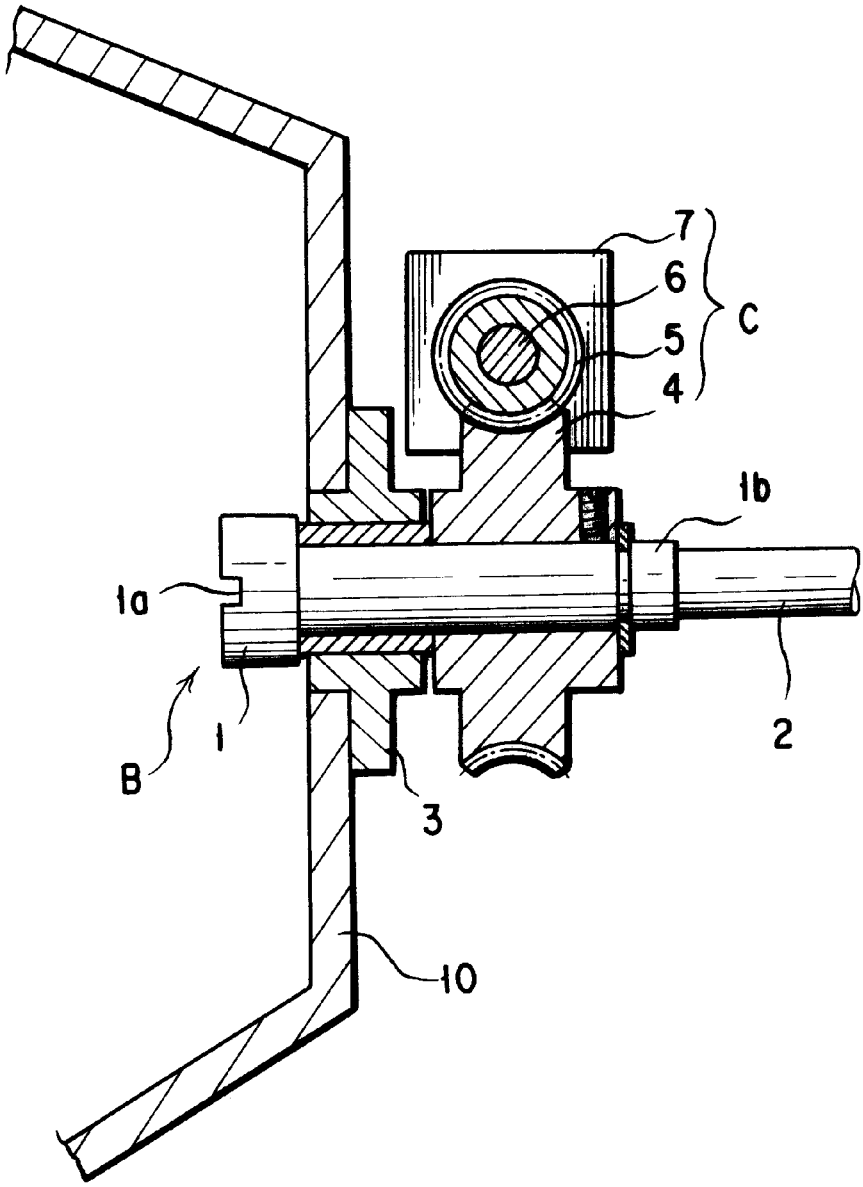
FIG. 3 is an enlarged, fragmentary vertical section of the dampening mechanism, showing in particular the means for revolving the sprayer in order to cause angular displacement of the spray.

As shown in both FIGS. 1 and 3, the sprayer B has a spray nozzle 1 which is mounted to the back of the shroud 10 and which rotatably extends into the interior of the shroud via a sleeve bearing 3. Within the shroud 10 the front end opening 1*a* of the spray nozzle 1 is directed toward the water roller 13. Lying outside the shroud 10, on the other hand, the rear end 1*b* of the spray nozzle 1 is coupled to a conduit 2 in communication with a source, not shown, of moistening water under pressure.

The water exit opening 1*a* of the spray nozzle 1 is configured according to the invention to spray water in the shape of a sector as in FIG. 1. Although an elongate ellipse is a preferred cross sectional pattern of the spray W, this should not be taken to exclude other shapes such as an elongate circle or a rectangle, all that is required being that the spray pattern be different in the dimensions in two orthogonal directions. The spray nozzle 1 may emit spray either continuously or at regular intervals without inconvenience in attaining the objectives of this invention.

Sprayer Revolving Means

As pictured in perspective in FIG. 1 and in section in FIG. 3, the sprayer revolving means C include an electric bidirectional drive motor 7 which revolves the spray nozzle 1 via worm gearing in this particular embodiment. The worm gearing comprises a worm wheel 4 fixedly mounted on the spray nozzle 1 for joint rotation therewith, and a worm 5 fixedly mounted on a drive shaft 6. The drive shaft 6 is coaxially coupled to the output shaft of the drive motor 7 on the back of the shroud 10. The worm wheel 4 and the worm 5 are in mesh with each other. Extending horizontally and at right angles with the axis of the worm wheel 4, the drive shaft 6 is rotatably mounted to the back of the shroud 10 and locked against axial displacement.

The sprayer drive motor 7 may take the form of a stepper motor in practice, which rotates in short and essentially uniform angular movements and which is easy to control electronically. The rotation of such a motor is imparted via the worm gearing 4 and 5 to the spray nozzle 1 and, in consequence, to the sectorial water spray W.

In usual applications of this invention, a plurality of sprayers B are aligned along the axis of the water roller 13 shown in FIG. 4, or of a plate cylinder for spraying different surface portions of the water roller or the like. It is understood that, disposed with its output shaft parallel to the axis of the water roller 13, as shown in FIGS. 1, 3 and 4, the sprayer drive motor 7 is used for jointly revolving all the spray nozzles 1 and, in consequence, for jointly adjusting the supply rates of water from all the spray nozzles to the printing speed. A required number of worms 5 are mounted on the common drive shaft 6 for engagement with respective worm wheels 4 on the spray nozzles 1.

Figure 5:
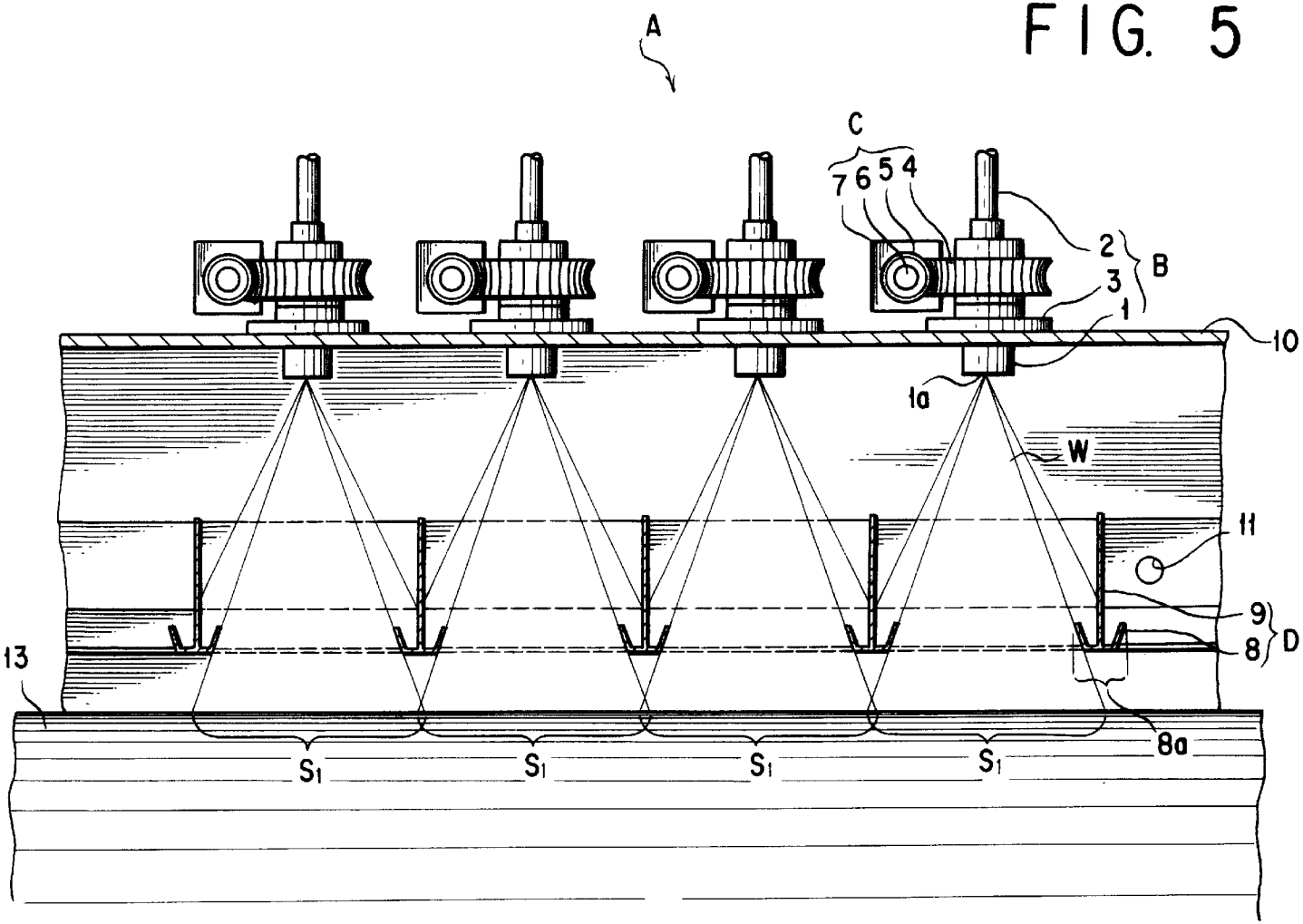
FIG. 5 is a horizontal section through another preferred form of a dampening mechanism according to the invention, incorporating a plurality of sprayers for moistening different axial portions of the water roller.

Alternatively, as shown in FIG. 5, there may be provided sprayer revolving means C for each sprayer B. All the sprayer revolving means are of like construction, each comprising an electric motor 7 and worm gearing 4 and 5. This embodiment permits individual control of the supply rate of water from each sprayer B. As an additional alternative, as in the case of newspaper printing presses, there may be provided as many discrete drive shafts as there are plates for respective pages. The drive shafts may be coupled one to each motor for jointly revolving each group of spray nozzles.

Baffle Means

With reference to both FIGS. 1 and 2 the baffle means D include a pair of baffle plates 8 which are disposed forwardly of the sprayer B and which are horizontally spaced from each other to provide the aperture 14. Traveling through this aperture 14, the water spray W from the sprayer B has the longitudinal dimension of its cross section controllably varied by the baffle plates 8, resulting in controlled delivery of the moistening water to the water roller 13. An inspection of FIG. 4 will show that, extending vertically within the shroud 10, the pair of baffle plates 8 have their top and bottom ends secured to the top and bottom walls of the shroud.

As will be best understood from FIG. 2, the aperture 14 between the baffle plates 8 has a width L (i.e. dimension in a direction parallel to the axis of the water roller 13) that is less than the longitudinal dimension of the cross section of the spray W and greater than the transverse dimension of the cross section of the spray, both cross-sectional dimensions of the spray under comparison being as measured in a plane containing the aperture 14. Therefore, when sprayed toward the water roller 13 with the longitudinal direction of its cross section laid parallel to the axis of the water roller, as indicated by the solid lines in FIG. 2, the spray W will have its opposite longitudinal end portions Sa of approximately equal size interrupted to the utmost by the baffle plates 8. Only the dotted midportion of the spray will be allowed through the aperture 14 and reach the water roller 13.

Further these opposite end portions Sa of the spray W are infinitely variable in size as the sprayer B is revolved by the means C to vary the angle of the spray about an axis passing through the geometric center of its cross section. The spray W will wholly traverse the aperture 14 when turned to the angular position indicated by the alternating dot-and-dash-line in FIG. 2.

It will now be apparent that the uninterrupted midportion of the spray W is minimum in size when the spray is in the solid-line position X of FIG. 2, maximum when it is in the dot-and-dash-line position Y, and infinitely variable between these two positions. The solid-line position X may be called the minimum dampening position because there, the spray W has its opposite end portions cut off to the utmost by the baffle plates 8, and the dot-and-dash-line position Y the maximum dampening position because there, substantially the entire spray is allowed through the aperture 14. The minimum dampening position X represents the normal position of the sprayer B, it being held in that position, as in FIG. 1, when the printing machine is at rest.

FIG. 1 reveals a pair of partitions 9 which are joined right-angularly one to each baffle plate 8 and extending rearwardly therefrom. The pair of partitions 9 bound one spray compartment in combination with the pair of baffles 8 and serve to prevent the stray or uncontrolled drops of the spray from entering neighboring compartments.

Electronic Control Means

The electronics E for controlling the stepper motor 7 which revolves the sprayer B is shown as a simple block in FIGS. 1 and 4 because the involved circuitry is considered largely conventional and well known to the electronics engineers. The electronic control means E functions to control the sprayer drive motor 7 in order to: (a) hold the sprayer B in the minimum dampening position X when the machine is out of operation; (b) vary, with the startup of the machine, the angular attitude of the sprayer anywhere between the minimum and the maximum dampening positions for optimum dampening of the unshown plate according to the printing speed; and (c) return the sprayer to the minimum dampening position X when the machine is set out of operation.

In order to enable the electronic control means E to make such control of the sprayer drive motor 7, there is input to the control circuitry a signal representative of the printing speed. The control circuitry is conventionally equipped to process the input printing speed signal in order to cause the motor 7 to vary the angular position of the sprayer B for moistening the water roller 13 at a rate depending upon the printing speed.

The electronic control means E is also required as aforesaid to return the sprayer B to the minimum dampening position X when the printing speed drops to zero. In order to make this possible it is understood that means such as a potentiometer, not shown, are provided for sensing the angular position of the sprayer B or the angle of rotation of the motor 7, of which the electronic control means is kept informed by a signal fed back from such means.

Optionally, the electronic control means E may be configured to accept signals that are delivered from the control board, not shown, as the machine operator inputs thereon a desired rate of dampening water supply which may be greater or less than normal. In response to such signals the electronic control means E should preferably be capable of modifying the normal motor control signal accordingly.

Operation

When the printing machine is out of operation, the spray nozzle 1 is held at an angle to produce the spray W in the minimum dampening position X. The sprayer B will start spraying with the startup of the machine, as then the unshown source of dampening water under pressure is automatically set into operation. The spray W being thus produced, including that spray not actually hitting the water roller 13, will be produced under constant pressure and at a constant rate.

Being now in the minimum dampening position X indicated by the solid lines in FIG. 2, the spray W when traveling through the aperture 14 of the baffle means D will have its opposite terminal portions Sa interrupted to the utmost by the pair of baffle plates 8. The supply rate of the water actually moistening the face of the water roller 13 will therefore be at a minimum. The water that has been interrupted by the baffle plates 8 will collect on the bottom of the shroud 10 and flow into the drain port 11. The drain may be either discarded or preferably, after having its solid contaminants filtered out, reused.

As has been mentioned, the spray W takes the shape of a sector, flaring as it goes farther away from the nozzle 1. Consequently, the uninterrupted midportion of the spray W will strike the water roller 13 with its longitudinal dimension made greater than the width L of the aperture 14.

This flaring spray pattern will manifest itself as a particular advantage when, as shown in FIG. 5, a plurality of sprayers B are aligned along the axis of the water roller 13 for moistening the same throughout its axial dimension. The spray patterns $S_1$ on the water roller 13 will either touch or overlap each other if the sprayers B are aligned with sufficiently small spacings and the baffle plates 8 made sufficiently narrow in width 8*a*. It will be possible in this manner to moisten the water roller 13 uniformly throughout its length, no matter how long the water roller, and therefore the plate cylinder, may be.

With an increase in printing speed the electronic control means E will respond by causing corresponding energization of the sprayer-revolving motor 7. The rotation of this motor will be imparted via the worm gearing 4 and 5 to the spray nozzle 1, causing the same to rotate counterclockwise, as viewed in FIGS. 1 and 2, relative to the sleeve bearing 3 on the shroud 10. As the spray nozzle 1 is rotated, so will be the spray W from the minimum dampening position X toward the maximum dampening position Y.

The opposite lateral end portions Sa of the spray W which are interrupted by the pair of baffle plates will gradually diminish in cross sectional area with the revolution of the spray. The uninterrupted mid-portion of the spray W will thus increase progressively and perfectly continuously, instead of in discrete steps as in the noted prior art, until the spray arrives at the maximum dampening position Y where the spray is allowed through the baffle aperture 14 wholly uninterrupted.

Although the electronic control means E enables automatic control of the dampening rate according to the printing speed as above, it should preferably be constructed to permit manual override as well. If it is desired or required to make the dampening rate higher or lower than normal during the startup or normal operating periods of the machine, the electronic control means should be capable of causing the motor 7 to correspondingly modify the angular position of the sprayer B.

Notwithstanding the foregoing detailed disclosure it is not desired that the instant invention be limited by the exact showing of the drawings or the description thereof. For example, the provision of the electronic control means E is not mandatory, as the motor 7 might be manually turned on and off to adjust the supply rate of moistening water to the printing speed. Even the motor itself might be omitted; instead, for example, a handle or grip might be coupled to the shaft 6 for manually revolving the sprayer or sprayers B.

These and other modifications, alterations and adaptations of the present invention are intended in the foregoing disclosure. It is therefore appropriate that the invention be construed broadly and in a manner consistent with the fair meaning or proper scope of the following claims.

What is claimed is:

1. A dampening mechanism for use in offset lithography, comprising:

(a) sprayer means for producing a spray of dampening water, the spray being of such cross sectional shape as to differ in dimensions in two orthogonal directions;

(b) sprayer rotating means for rotating the sprayer means in order to cause angular displacement of the spray about an axis passing through the geometric center of the cross section of the spray; and (c) baffle means defining an aperture through which the spray travels, the aperture having a width shorter than the longer dimension of the cross section of the spray and longer than the shorter dimension of the cross section of the spray, both cross sectional dimensions of the spray under comparison being measured in a plane containing the aperture;

(d) whereby the supply rate of dampening water that is allowed through the aperture is infinitely variable by changing the angular position of the spray relative to the aperture between a minimum dampening position where the spray has opposite longitudinal end portions of its cross section interrupted to the utmost by the baffle means and a maximum dampening position where the spray is allowed wholly through the aperture.

2. The dampening mechanism of claim 1 wherein the sprayer rotating means comprises an electric bidirectional drive motor, and wherein the damping mechanism further comprises control means connected to the drive motor for automatically controlling the supply rate of dampening water.

3. A mechanism for dampening an object such as a water roller in offset lithography, comprising:

(a) a plurality of sprayers to be disposed in alignment along an axis of rotation of a water roller or the like for producing sprays of dampening water directed toward the water roller or the like, each spray being of such cross sectional shape as to differ in dimensions in two orthogonal directions;

(b) sprayer rotating means for rotating the sprayers in order to cause angular displacement of the sprays about respective axes passing through the geometric centers of the cross sections of the sprays; and (c) baffle means defining a plurality of apertures through which the sprays travel toward the water roller or the like, each aperture having a width shorter than the longer dimension of the cross section of each spray and longer than the shorter dimension of the cross section of each spray, both cross sectional dimensions of the sprays under comparison being measured in a plane containing the apertures;

(d) whereby the supply rates of dampening water that are allowed through the aperture are infinitely variable by changing the angular position of the sprays relative to the apertures between a minimum dampening position where each spray has opposite longitudinal end portions of its cross section interrupted to the utmost by the baffle means and a maximum dampening position where each spray is allowed wholly through one of the apertures.

4. The dampening mechanism of claim 3 wherein the sprayer rotating means comprises:

(a) an electric motor;

(b) a drive shaft coupled to the motor thereby to be rotated; and (c) gear means through which the drive shaft is coupled to each sprayer.

5. The dampening mechanism of claim 3 wherein the sprayer rotating means comprises:

(a) a plurality of electric motors;

(b) a plurality of drive shafts each coupled to a corresponding motor thereby to be rotated; and (c) gear means through which each drive shaft is coupled to one sprayer.

* * * * *